US005775058A

United States Patent [19]

Hirschek

[11] Patent Number: 5,775,058

[45] Date of Patent: Jul. 7, 1998

[54] PROCESS AND DEVICE FOR PACKING PRESSED BALES AS WELL AS PACKING MATERIAL BLANK

[75] Inventor: Herwig Hirschek, Bobingen, Germany

[73] Assignee: Autefa Maschinenfabrik GmbH, Friedberg, Germany

[21] Appl. No.: 693,152

[22] PCT Filed: Feb. 16, 1995

[86] PCT No.: PCT/EP95/00563

§ 371 Date: Aug. 7, 1996

§ 102(e) Date: Aug. 7, 1996

[87] PCT Pub. No.: WO95/22490

PCT Pub. Date: Aug. 24, 1995

[30] Foreign Application Priority Data

Feb. 17, 1994 [DE] Germany ..... 42 05 120.4

[51] Int. Cl.[6] ..... B65B 53/00; B65B 27/12

[52] U.S. Cl. ..... 53/399; 53/441; 53/556; 53/586

[58] Field of Search ..... 53/399, 438, 441, 53/477, 556, 586

[56] References Cited

U.S. PATENT DOCUMENTS

| | | | |
|---|---|---|---|
| 2,322,298 | 6/1943 | Johnstone | 53/477 X |
| 2,545,243 | 3/1951 | Rumsey | 53/441 X |
| 3,867,806 | 2/1975 | Lancaster et al. | 53/441 |
| 4,244,471 | 1/1981 | Plante | 53/441 X |
| 4,418,114 | 11/1983 | Briggs et al. | 53/441 X |
| 4,691,497 | 9/1987 | Lancaster | 53/441 X |
| 4,914,892 | 4/1990 | Saito et al. | 53/399 |
| 5,125,210 | 6/1992 | Lang et al. | 53/438 X |
| 5,351,461 | 10/1994 | Fandard et al. | 53/556 X |
| 5,369,935 | 12/1994 | Lang et al. | 53/399 |
| 5,477,658 | 12/1995 | Berger et al. | 53/441 X |

FOREIGN PATENT DOCUMENTS

| | | |
|---|---|---|
| 1951113 | 4/1971 | Germany . |
| 2408305 | 8/1975 | Germany . |
| 4121573 | 1/1993 | Germany . |
| 311783 | 2/1930 | United Kingdom . |

*Primary Examiner*—Linda Johnson
*Attorney, Agent, or Firm*—McGlew and Tuttle

[57] ABSTRACT

The invention relates to a process ad device for packing pressed bales of cut or stranded textile fibers in a bale press with one or more elastic packing blanks which are wrapped and secured around the bales. The packing blanks are overlapped and bonded together at the contact point adhesively or by welding. Use is made for this purpose of multi-layer packing blanks with a retaining structure and, at least locally, a weldable and/or adhesive coating, the coatings of the packing blanks being brought into mutual contact. Bonding is achieved by pressure and/or heat.

17 Claims, 2 Drawing Sheets

Fig 2
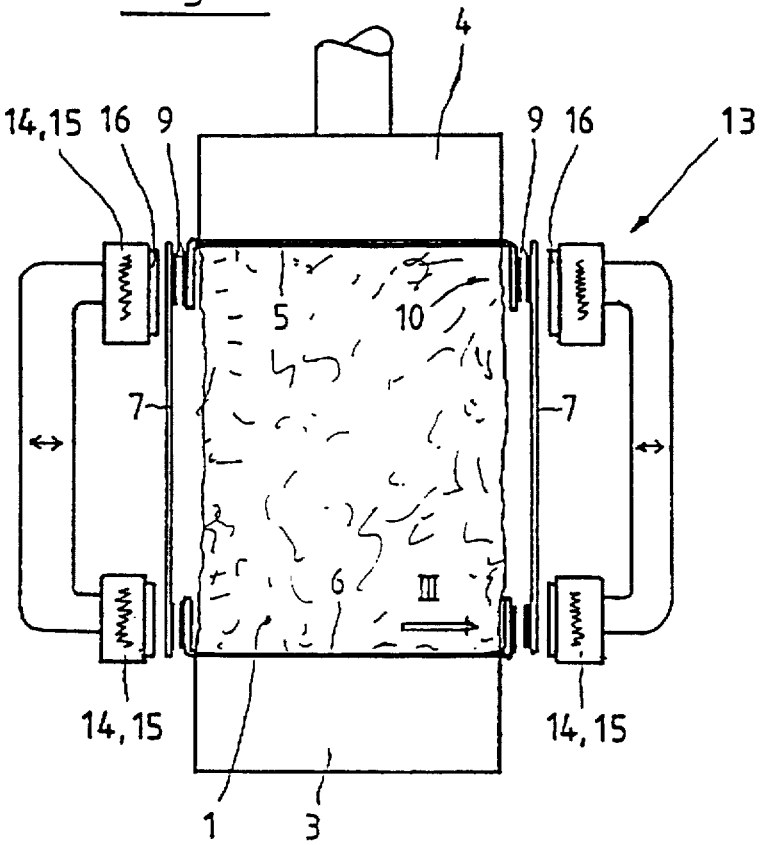
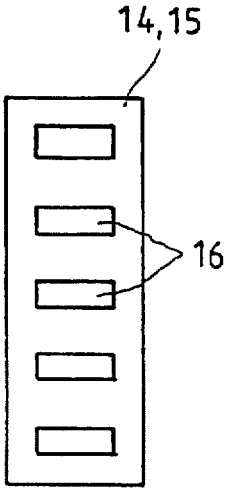
Fig 3
Fig 5
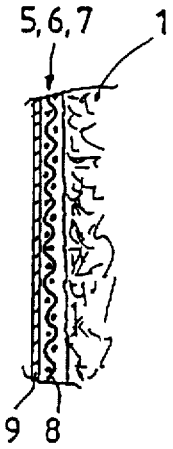
Fig 4
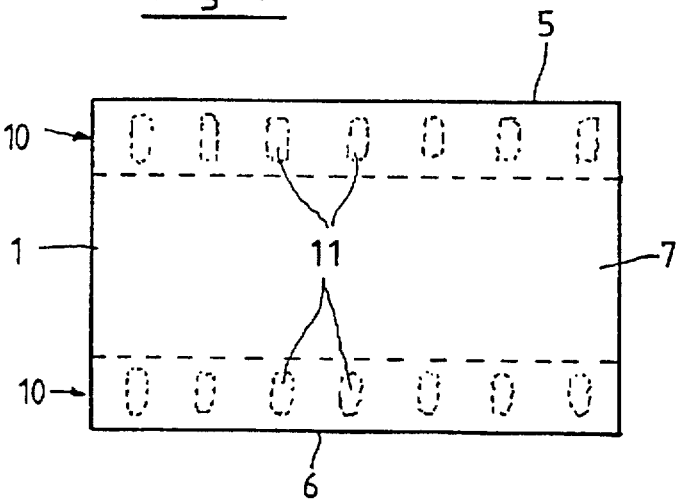

PROCESS AND DEVICE FOR PACKING PRESSED BALES AS WELL AS PACKING MATERIAL BLANK

FIELD OF THE INVENTION

The present invention pertains to a process and a device for packing pressed bales of fibrous materials, especially cut or a strand-like textile fibers, in a baling press with one or more elastic packing material blanks placed around the pressed bale with a overlap, wherein the pressed bale is under a high pressing pressure and the packing material blanks are connected to one another by bonding and/or melting.

BACKGROUND OF THE INVENTION

Such a packing process as well as a packing device in conjunction with a baling press have been known from DE-A-19 51 113. The bale is packed in the baling press with two bags, which are placed over each other with an overlap and are welded together in the overlapping areas. The packing bags are pliable and are stretchable to absorb the expansion pressure of the material. If the expansion of the bale becomes too high, the bale is additionally provided with a tightening strap or a cording which absorbs the forces. The one-layer plastic bags are connected to one another by a welding device arranged on the press box with extending welding dies. The overlapping area is located at the lower pressing or cording plate, which is used as an opposite pole or abutment for the welding process. Due to this manner of overlapping, in which the lower bag is turned over in the rearward direction, the packaging is loosely in contact with the bale. The bale will somewhat expand when the pressure is released, and it will completely fill the package and tighten it only then. The overlapping area now moves upward and is subjected to shear by the expansion forces. Without additional strapping and cording, the prior-art packing technique is suitable only for relatively low pressing and expansion forces as well as for slightly compacted pressed bales.

Similar processes and devices are also shown in DE-A-40 15 642, DE-A-40 15 643, DE-A-29 11 958, and DE-A-29 48 237. In these cases, highly compacted pressed bales of fibrous materials, especially cut or strand-like textile fibers, are packed in a baling press with one or more elastic packing material blanks and subsequently provided with a tightening strap made of metal or plastic strips. The tightening strap secures the package and the pressed bale. In the case of three-film packing, the packing material blank intended as a body belt is pulled off from a film roll in the length needed and is welded together at the ends to form a closed ring around the pressed bale. However, there is only a loose connection, which is fixed by the tightening straps, between the body belt and the packing material blanks acting as the cover or bottom.

The tightening straps have the drawback that they make the further processing of the pressed bales difficult. The tightening strips are cut off or severed in another manner with a suitable tool. This involves the risk that the pressed bale will be damaged. On the other hand, there is a certain risk of accident for the operators during the opening of the tightening strips.

DE-A 41 21 573 teaches a wrapping for solid bodies, which consists of a plurality of layers of roll film, which are connected to one another by an adhesive layer. The roll films are paper or stretch films, which do not withstand a higher load and are unsuitable for packing highly compacted and expanding pressed bales. Moreover, the winding technique cannot be used in the case of a pressed bale if the latter is held between two press dies during the packing process.

SUMMARY AND OBJECTS OF THE INVENTION

The object of the present invention is therefore to show a possibility of improved packing of pressed bales.

According to the invention, a process is provided for packing pressed bales of fibrous material, especially cut or strand-like textile fibers. A baling press is employed for forming pressed bales. One or more elastic packing material blanks are pressed around the pressed bale with an overlap wherein the pressed bale is under a high pressing pressure. Packing material blanks are connected to one another by bonding and/or melting. The packing material blank has a tensile strength and stretching resistance wherein the blanks are formed of at least two parts with a force-absorbing support insert and with a meltable and/or bondable coating that is present in some areas of the blank. The overlaps of the packing material blanks are placed on lateral surfaces of the pressed bale and are subsequently bonded and/or melted, lying on the pressed bale, in a shear resistant manner.

According to the invention, a device for packing pressed bales of fibrous material, especially cut or strand-like textile fibers is provided including a baling press. One or more elastic packing material blanks are provided which are placed around the pressed bale with an overlap. When the pressed bale is under high pressure the packing material blanks are connected to one another by bonding and/or melting together by means of a movable sealing device. The packing device includes a folding device which places the packing material blanks, which have a tensile strength and stretching resistance, over lateral surfaces of the pressed bale in the manner defining overlap portions. The sealing device can be fed to the press bale for welding and/or bonding together the packing material blanks in a shear resistant manner.

According to a further feature of the invention, an elastic packing material blank is provided for packing pressed bales of fibrous materials, especially cut or strand-like textile fibers, in a baling press. The blank comprises a plurality of components with a meltable and/or bondable coating arranged in at least some areas (covering at least some portions of the components). The packing material blank has a support insert.

Strapping of the pressed bale can be abandoned with the process according to the present invention. The packing material blanks are placed, instead, around the bale with a mutual overlap and are connected to one another by bonding and/or melting together. The bonded and/or melted connection of the different packing material blanks to one another fixes the package.

The process according to the present invention is suitable for various types of packing. Two or three packing material blanks, which are folded around the pressed bale in a suitable manner, are used in practice. However, it is also possible to use a single packing material blank only in the form of a bag or tube, and to close the open ends by folding over and bonding and/or melting together.

The process according to the present invention is especially suitable for packing pressed bales in baling presses, in which the pressed bale is held between two press dies under high pressure during the packing process. The pressed bale preferably consists of fibrous materials, especially cut or strand-like textile fibers, which are also called staple fibers or tow. However, the pressed bale may also consist of another material.

The packing material blanks have tensile strength and stretching resistance and have a support insert, preferably in the form of a fabric, and a meltable and/or bondable coating. The use of multilayer packing material blanks consisting of at least two layers is particularly advantageous. The coating may serve various purposes. On the other hand, it may be present on the connection areas in some areas only, in which case it is used above all to prepare the bonded or welded connection. The coating may be a glue that can be activated by pressure and/or temperature and/or by a chemical reaction, or a low-melting composition. Moreover, the coating may also perform sealing and protective tasks for the pressed bale, in which case it is preferably applied to the entire surface of the support insert.

It is particularly advantageous to prepare strip-shaped or punctiform (e.g. discrete melted connection sites) connections, which, though having a high shear strength, can be easily separated by peeling by hand or with a machine. On the one hand, the package thus withstands the expansion forces exercised by the bale very well, but, on the other hand, it can also be removed in a simple manner and especially without the risk of injury to the pressed bale. In addition, the packing material blanks can be removed from the pressed bale completely and without residues.

It is recommended that the packing material blanks be made of plastic, especially polyethylene. It is advantageous for reasons of recycling for the support insert and the coating to consist essentially of the same type of plastic. Additional advantages arise if the materials of the support insert and of the coating have different melting points, which favorably supports the bonding and/or melted connection. Polyethylene, in which different strengths and melting points can be specifically set by different manufacturing processes and inner structures, is especially suitable for this purpose.

The packing device may be of a prior-art type concerning the components of the device for feeding in, laying on, and folding the packing material blanks. It has a sealing device that can be fed for preparing the bonded and/or welded connection(s). The sealing device may have various designs and has a heating device and/or a pressing device. To form the punctiform or strip-shaped connections, it is recommended that a plurality of punctiform (e.g. discrete dies) or strip-shaped individual dies of a corresponding shape be provided on the sealing device, with which the packing material blanks are pressed to each other at the connection points in a punctiform or strip-shaped pattern and are optionally heated on this limited contact surface.

The process preferably includes placing the packing material blanks with the inside over the outside to define the overlap portions. The packing material blanks with their coatings, are preferably brought mutually into contact. The packing material blanks may be held together during the connection process by pressure and/or heat. The blanks preferably are created with strip-shaped or punctiform connections. These blanks may be made of plastic and are preferably polyethylene. The support insert and the coating preferably comprise essentially the same type of plastic (consist of the same plastic). The material of the support insert and the coating preferably have different melting points. However, the melting point of the support insert may advantageously be higher than the melting point of the coating.

The sealing device of the device of the invention preferably has a heating device and/or pressing device. The sealing device has a plurality of punctiform or strip-shaped individual dies.

The packing material blank support insert is preferably designed as a fabric. The coating is preferably arranged on at least one side of the support insert and covers it, over its entire surface. The packing material blank itself preferably consists of plastic, most desirably polyethylene. The support insert and the coating consists essentially the same type of plastic however support insert and the coating may also be provided with different melting points and advantageously the melting point of the support insert is higher than the melting point of the coating.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 2 is a side view of the clamped and packed pressed bale with a sealing device according to arrow II in FIG. 1;

FIG. 3 is a top view of a part of the sealing device according to arrow III in FIG. 2;

FIG. 4 is a side view of a packed pressed bale; and

FIG. 5 is a cutaway cross-sectional representation of a pressed bale and of a packing material blank.

DESCRIPTION OF THE PREFERRED EMBODIMENT

Figure 1:
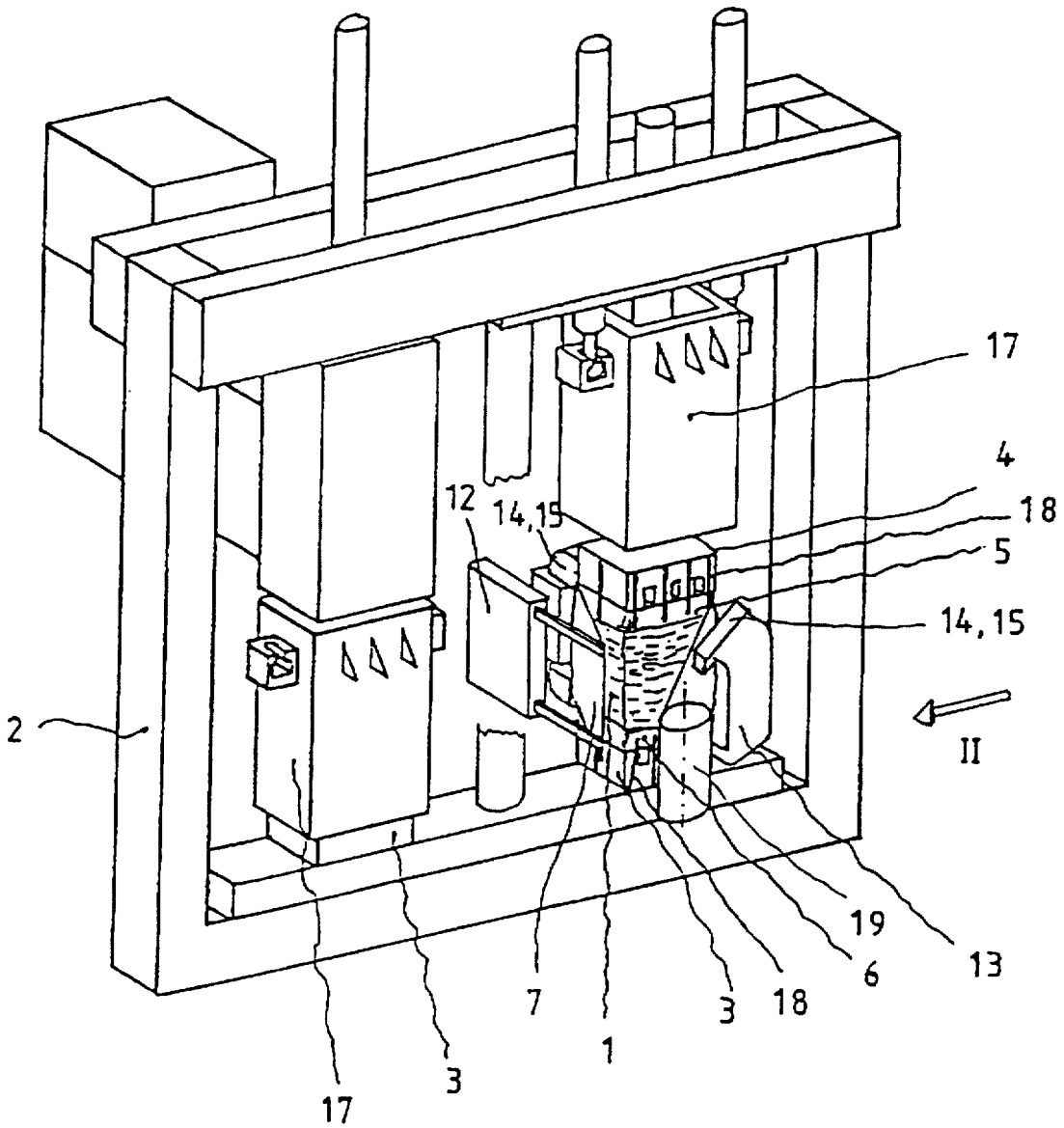
FIG. 1 is a perspective view showing a baling press with a pressed bale and a packing device.

FIG. 1 shows a baling press 2 for preparing and packing pressed bales 1. The pressed bales consist of fibrous materials, especially short-staple or strand-like textile fibers, so-called staple fibers or tow. The baling press 2 is a rotary press, but it may also have any other design, e.g., a central press system with a plurality of prepresses or the like.

The fibers are filled into a press box 17 and compacted into a bale 1 with press dies 3, 4 under high pressure. The press dies 3, 4 develop high pressing forces of several 100 tons, e.g., 500 tons. The bales 1 have a weight of about 300–700 kg. The pressed bale 1 is wrapped into a plurality of packing material blanks 5, 6, 7 and packed. Three packing material blanks 5, 6, 7 are used in the embodiment shown, and the packing material blanks forming the cover 5 and the bottom 6 are placed on the corresponding press dies 3, 4 before the filling of the press box 17 and are fed by the press dies against the pressed bale 1. The cover 5 and the bottom 6 are subsequently folded onto the lateral surfaces of the pressed bale 1 by a folding device 18. The third packing material blank 7 in the form of a body belt is then placed around the pressed bale 1. It is pulled off from a film roll 19 for this purpose.

This form of packing is illustrated in FIGS. 2 and 4. As an alternative, it is also possible to first place the body belt 7 around the pressed bale 1 and subsequently place and fold the cover 5 and the bottom 6 over it.

The folding device 18 and the devices for feeding the packing material blanks 5, 6, 7 may have any desired design. The embodiment shown and described above corresponds to the folding technique known from DE-OS 40 15 642 and DE-OS 40 15 643. Instead of the three-film packing described here, it is also possible to use a two-film packing, as is known from, e.g., U.S. Pat. No. 3 816 970 with the corresponding device.

It is also possible to use a single packing material blank (not shown), which is a bag open on one side or a tube open on two sides. After filling, the bag or tube is closed at the open ends by a suitable folding technique, and then fixed.

The packing material blank or packing material blanks 5, 6, 7 are connected to one another according to the present invention by welding and/or bonding. A wrapping or package closed on all sides, which withstands the forces of the swelling bale even after the release of the pressing pressure acting on the pressed bale 1, is thus obtained for the pressed bale 1. The present invention makes it possible to abandon the additional reinforcement of the package by strips or tightening straps or the like. However, such reinforcements may still be present in an impaired embodiment.

During the packing of the pressed bale 1, the individual packing material blanks 5, 6, 7 are placed around the pressed bale 1 with a mutual overlap 10 of at least pairs of the packing material blanks. The overlaps 10 form the connection points. The packing material blanks 5, 6, 7 are bonded and/or welded together by means of a sealing device 13, as a result of which the so-called connections 11 are created.

The sealing device 13 is preferably a part of the packing device 12 and is moved together with it in relation to the clamped pressed bale 1. The components of the packing and sealing device 12, 13 are arranged for this purpose on trolleys traveling on both sides of the pressed bale 1. Such trolleys have been known from, eg., DE-OS 40 15 643. However, another conveying system, e.g., one according to DE-OS 29 11 958, may be present as well.

The sealing device 13 has a heating device 14 and/or a pressing device 15. The particular design and arrangement depends on the connection technique selected, which will be described below.

As is illustrated in FIG. 5, the packing material blanks 5, 6, 7 have a multilayer structure, preferably consisting of two layers. They consist of a firm support insert 8, preferably in the form of a fabric, which absorbs the forces exercised by the expanding pressed bale 1 and stabilizes the package. The support insert 8 may also have embedded reinforcing strips or have another suitable design.

It is provided at least at the connection points 10 with a coating 9, which makes it possible to prepare the bonded and/or melted connection. The coating 9 is present on at least one side of the support insert 8. In the preferred embodiment, the fabric is laminated with a coating 9 over its entire surface. As a result, the coating 9 envelopes the pressed bale 1 and protects it from external environmental effects, such as contamination, water, etc. The firm support insert 8 additionally protects the pressed bale 1 from mechanical damage.

In the preferred embodiment, the packing material blanks 5, 6, 7 consist of plastic. They preferably have a high tensile strength, but they can be folded and bent. They are sufficiently elastic to be able to be placed around the pressed bale 1 in the desired manner, but they have a sufficient inner tensile strength and stretching resistance to maintain the shape of the pressed bale 1 after it has been released from the press dies 3, 4. The strengths needed depend on the type of the material of the bale and can be varied.

It is recommended that the support insert 8 and the coating 9 of the packing material blanks 5, 6, 7 be made of the same type of plastic. As a result, they can be recycled more easily. Polyethylene possesses especially favorable properties for this.

In addition, the support insert 8 and the coating 9 preferably have different melting points, and the melting point of the support insert 8 is higher than that of the coating 9. This is again advantageous in connection with polyethylene. Due to the low melting point, the coating 9 can be melted by the sealing device 13 without the support insert 8 being damaged.

In the preferred embodiment, the packing material blanks 5, 6, 7 consist of polyethylene. The sealing device 13 also has a heating device 14 in this case, besides the pressing device 15. The sealing device 13 is adapted to the arrangement of the overlaps 10 or connection points. The pressing device 15 consists of a plurality of pressing bars, which extend along the overlaps 10 and can be fed to the pressed bale 1 individually or together via suitable drives. Heating devices 14 are integrated in the pressing bars. The heating devices may be electric resistance heaters, tube systems operated with fluidic heating agents, or the like.

As is shown in FIGS. 2 and 4, the pressing bars have a plurality of strip-shaped individual dies 16 arranged at laterally spaced locations from one another, which slightly project and produce melted and/or bonded strips 11 at the connection points 10 when pressed on. They preferably extend vertically or at right angles to the longitudinal direction of the overlaps 10. The individual dies 16 and the melted strips or connections 11 may also be punctiform (e.g. discrete melted connection sites). However, a connection periodically interrupted along the overlaps 10 is formed.

The punctiform or strip-shaped connections 11 offer sufficient strength against the normal forces occurring in the bale. They have a high shear strength. On the other hand, they can be relatively easily separated by peeling by hand or with a suitable machine if the outer packing material blank is pulled off at right angles to the pressed bale 1.

In the preferred embodiment, the packing material blanks 5, 6, 7 consisting of polyethylene are connected by supplying heat while pressing on the sealing device 13. It is recommended that the individual packing material blanks 5, 6, 7 be directed and placed around the pressed bale 1 such that the coatings 9 will come to lie on each other at the connection points 10. In the embodiment according to FIG. 2, the coating on the cover 5 and on the bottom 6 is on the outside, while it is on the inner side facing the pressed bale 1 on the body belt 7. The fabric 8 is thus located on the outside on the body belt 7. The coatings 9 in contact with one another melt by applying pressure and supplying heat and are bonded together.

As an alternative, it is also possible in the packing material blanks 5, 6 to bring a fabric side 8 into contact with a coating side 9 and to tack them together by slightly melting the coating 9. It is thus possible, e.g., to place the ends of the body belt 7 overlappingly on each other and to tack them.

In another alternative, the coating 9 may consist of a suitable glue. Various possibilities are available for this. It is possible, e.g., to embed encapsulated glue beads in the coating 9, which will burst under the pressure of the pressing device 15 pressed on, release the glue, and ensure a connection as a result. The supply of heat and a heating device 14 can be abandoned in this embodiment, in which the connecting action of the coating 9 is activated by pressure alone. It is also recommended in this embodiment that the coating 9 be provided in the overlapping areas or connection points 10 only. The packing material blanks 5, 6, 7 may also have more than two layers in these and other cases, e.g., by impregnating or laminating the support insert 8 with an additional, sealing coating.

In another alternative, the coating 9 may also consist of a hot-melt adhesive, which is activated by applying pressure and supplying heat. It is also possible to use contact adhesives consisting of two separate, different components, which react chemically and are connected to one another when coming into contact with each other. In this case, the components would be present, e.g., in two coatings 9 to be brought into contact with one another in analogy to FIG. 2. Depending on the material selected and the treatment, exclusively bonded connections, exclusively melted connections, or combined bonded and melted connections may be formed with the different possibilities of connection.

Various modifications of the exemplary embodiment described are possible. Besides the above-mentioned variations in the technical design of the baling press 2, the selected material of the pressed bales 1 and the packing and folding technique, it is also possible to vary the sealing device 13. The pressing bars may also act on the overlaps or connection points 10 over the entire surface, rather than having strip-shaped or punctiform individual dies 16. In another modification, the individual dies 16 may be present in a smaller number with independent drives, and they are moved along the clamped pressed bale 1 and are alternatingly fed to prepare a connection 11 and are then moved further. The sealing device 13 may also be combined with the folding device 18 in such a way that the first melted strips or connections 11 are already applied while the folding device 18 is still placing the body belt 7 around the pressed bale 1.

Alternatives are possible in the selection of the material of the packing material blanks 5, 6, 7 as well. Besides polyethylene, other plastics or other elastic materials and materials having tensile strength or stretching resistance are suitable as well. Mixtures of materials are also possible, in which case different plastics may be used as well.

While specific embodiments of the invention have been shown and described in detail to illustrate the application of the principles of the invention, it will be understood that the invention may be embodied otherwise without departing from such principles.

I claim:

1. A process for packing pressed bales of fibrous materials, comprising:

employing a baling press to form a pressed bale under a high pressing pressure;

providing one or more elastic packing material blanks with a tensile strength and stretching resistance;

providing the packing material blanks with two parts including a force-absorbing support insert with a meltable and/or bondable coating provided in some areas of said insert;

disposing said packing material blanks to define overlaps of said packing material blanks on lateral surfaces of said pressed bale under a high pressing pressure;

connecting said packing material blanks to one another by bonding and/or melting portions of said blanks, with said packing material blanks lying on said pressed bale, in a shear-resistant manner to form a packaged pressed bale, wherein at least one overlap located on said lateral surface of said pressed bale is formed by pressing a sealing means against a lateral surface of said pressed bale to provide an overlap blank connection.

2. A process according to claim 1, wherein said packing material blanks are placed with an inside over an outside to form said overlap.

3. A process according to claim 1, wherein said packing material blanks including said coatings are brought mutually into contact.

4. A process according to claim 1, wherein said packing material blanks are held together during a connection process by pressure and/or heat.

5. A process according to claim 1, wherein said packing material blanks are created with strip-shaped or punctiform connections.

6. A process according to claim 1, wherein said packing material blanks are formed of polyethylene plastic.

7. A process according to claim 6, wherein said support insert and said coating are formed of the same type of plastic.

8. A process according to claim 1, wherein said support insert and said coating are formed of materials having different melting points.

9. A process according to claim 8, wherein a melting point of said support insert is higher than a melting point of said coating.

10. A device for packing pressed bales of fibrous materials, comprising:

a baling press with one or more elastic packing material blanks, each of said blanks having two parts including a force-absorbing support insert with a meltable and/or bondable coating provided in some areas of said insert;

folding means for placing said packing material blanks, which have a tensile strength and stretching resistance, over lateral surfaces of said pressed bale, wherein said pressed bale is under high pressure, to define overlap portions at a lateral surface of said pressed bale; and sealing means for pressing against said lateral surface of said pressed bale and connecting said packing material blanks, with said two parts, to one another by bonding and/or melting together to form an overlap blank connection which is provided in substantially the same position relative to said pressed bale as a position of said overlap portions at said lateral surface, said sealing means being moved to said pressed bale for welding and/or bonding together said packing material blanks in a shear-resistant manner.

11. A device according to claim 10, wherein said sealing device includes a heating device and/or a pressing device.

12. A device according to claim 10, wherein said sealing device includes a plurality of punctiform or strip-shaped individual dies.

13. A process according to claim 1, further comprising the step of one of moving and shipping the packaged pressed bale without tightening strips applied to said pressed bale and connected blanks of said the packaged pressed bale.

14. A process according to claim 1, wherein said overlap blank connection is provided in the same position relative to said pressed bale as a position of said overlap prior to said step of connecting.

15. A process for packing pressed bales of fibrous materials, comprising: employing a baling press to form a pressed bale under a high pressing pressure;

providing one or more elastic packing material blanks with a tensile strength and stretching resistance;

providing the packing material blanks with two parts including a force-absorbing support insert with a meltable and/or bondable coating provided in some areas of said insert;

disposing said packing material blanks to define an overlap of said packing material blanks on a lateral surface of said pressed bale under a high pressing pressure; and connecting said packing material blanks to one another by bonding and/or melting portions of said blanks, with said packing material blanks lying on said pressed bale, in a shear-resistant manner to form a packaged pressed bale, wherein said overlap located on said lateral surface of said pressed bale is formed by pressing a sealing means against a lateral surface of said pressed bale to provide an overlap blank connection, said overlap blank connection being provided in the same position relative to said pressed bale as a position of said overlap prior to said step of connecting.

16. A process according to claim 15, further comprising the step of one of moving and shipping the packaged pressed bale without tightening strips applied to said pressed bale and connected blanks of said the packaged pressed bale.

17. A device according to claim 10, wherein said sealing means forms a packaged pressed bale without tightening strips applied to said pressed bale and connected blanks of said the packaged pressed bale.

* * * * *